United States Patent [19]

O'Sheeran

[11] 3,942,290

[45] Mar. 9, 1976

[54] INTEGRATED BUILDING CONSTRUCTION

[76] Inventor: John H. O'Sheeran, Box 178 c/o Milwaukee Shell Corporation, Plum City, Wis. 54761

[22] Filed: Jan. 3, 1975

[21] Appl. No.: 538,257

[52] U.S. Cl. ..... 52/57; 52/90; 52/591; 52/594

[51] Int. Cl.[2] ..... E04B 7/02

[58] Field of Search ..... 52/90, 92, 86, 591, 758 D, 52/588, 301, 57, 594

[56] References Cited

UNITED STATES PATENTS

| | | | |
|---|---|---|---|
| 3,339,783 | 9/1967 | Gorman | 220/15 |
| 3,349,532 | 10/1967 | Dudoff | 52/301 |
| 3,354,590 | 11/1967 | Gilroy | 52/90 |
| 3,456,413 | 7/1969 | Fischer | 52/571 |
| 3,464,167 | 9/1969 | Mason | 52/90 |
| 3,632,149 | 1/1972 | König | 52/758 D |
| 3,646,716 | 3/1972 | Jenner | 52/90 |
| 3,675,379 | 7/1972 | Lambert | 52/588 |
| 3,760,551 | 9/1973 | König | 52/758 D |
| 3,771,277 | 11/1973 | Rausch | 52/90 |

*Primary Examiner*—Ernest R. Purser
*Assistant Examiner*—Henry Raduazo
*Attorney, Agent, or Firm*—Sughrue, Rothwell, Mion, Zinn & Macpeak

[57] ABSTRACT

An integrated building structure of A-frame form has a series of cored panels, each of which is provided at peripheral extremities with interlocking, dual connectors. The structural components of the building interlock with one another and are integrated through an elongated ridge pole with fastening means compatible with the connectors of the structural components.

11 Claims, 27 Drawing Figures

7
6
16
60
62
62a
90
98
100
104
202
204
210
212
214
216
218
220
222
224
226a
296
298
300
302
304
306
308
310
312
72
74
76
80
82

INTEGRATED BUILDING CONSTRUCTION

CROSS-REFERENCE TO RELATED PROPERTY

This invention derives from the materials of record in the Patent Office in Disclosure Document No. 022100, filed Sept. 19, 1973.

BACKGROUND OF THE INVENTION

1. Field of the Invention

This invention pertains to building structures generally, and more specifically to building structures in which cored structural components are maintained in interlocked relationship by a series of new and novel male and female connectors.

2. Statement of the Prior Art

It has heretofore been proposed to provide preformed building structures made up, in part, of cored building elements. Such elements have, however, involved erection by at least partially conventional building techniques, and have not resulted in a totally interlocked structure.

SUMMARY OF THE INVENTION

The present invention embodies particular structural features suited to the fabrication of inhabitable dwellings and similar structures. The unit employs preformed sections which are readily assembled to create high quality, low cost housing systems. The system is such that minimum site preparation is required, and the units are readily transported for assembly by nonskilled labor.

An important objective of the present invention resides in the utilization of a unique fastening system which consists of mated, male and female connectors, particularly designed for compatibility with the materials employed in creating the structure. The structural components are of a form such that the unit is well insulated in all quadrants, and may be formed at minimum expense and with minimum difficulty.

The manner of assembly permits disassembly where necessary. Moreover, the units may incorporate integrated accessory features such as wiring and plumbing.

Other and further objects and advantages of the invention will become apparent to those skilled in the art from a consideration of the following specification when read in conjunction with the annexed drawings.

DESCRIPTION OF THE PREFERRED EMBODIMENTS

Figure 1:
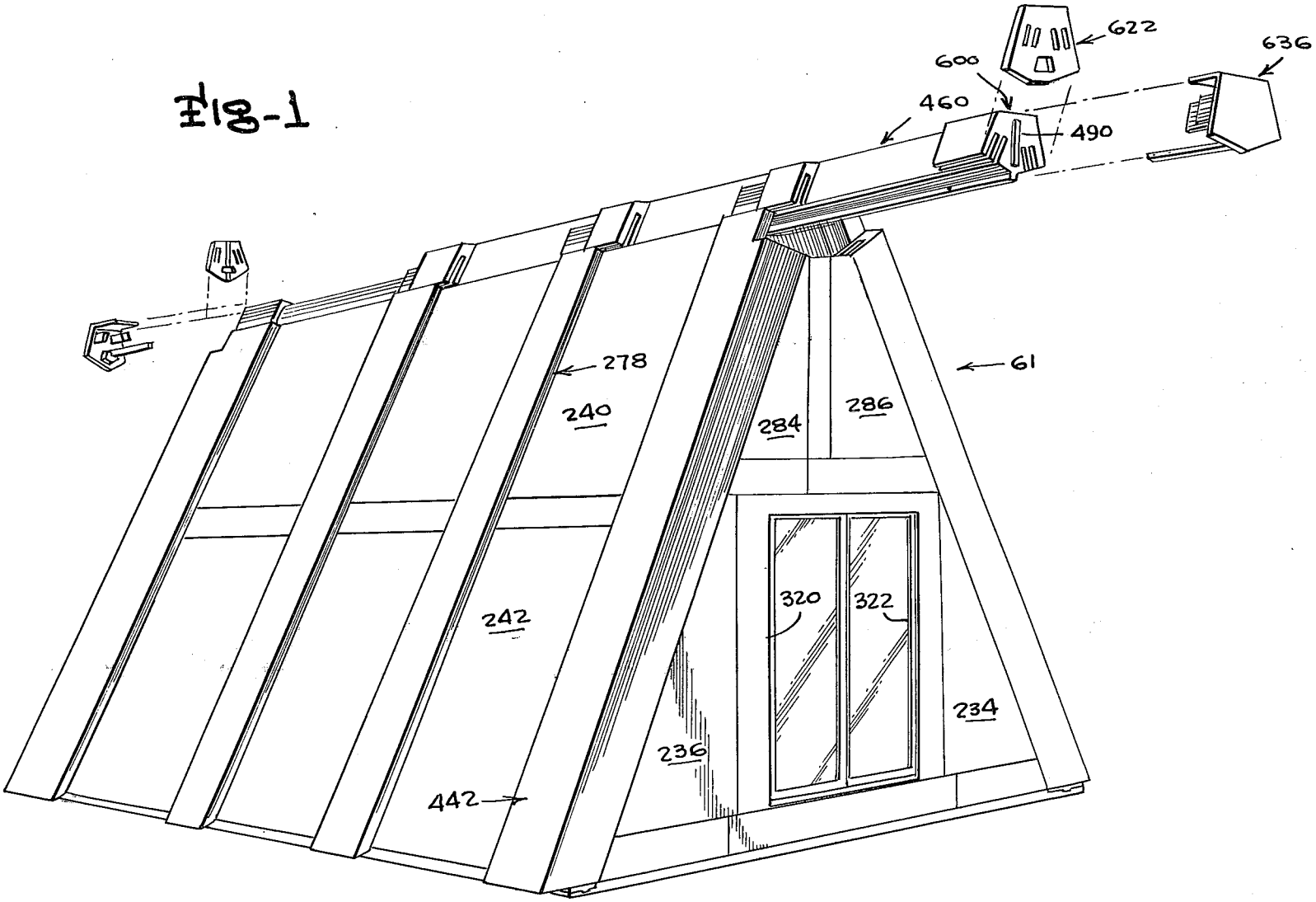
FIG. 1 is a partially disassembled perspective view of an integrated building structure according to this invention.

Referring to the invention in further detail, a housing unit constructed in accordance with this invention is seen in partially disassembled perspective view in FIG. 1 and is there generally identified by reference numeral 61. The following description relates to the structure in a sequence followed in normal assembly and thus commences with the floor assembly.

Figures 4A, 5, 6:
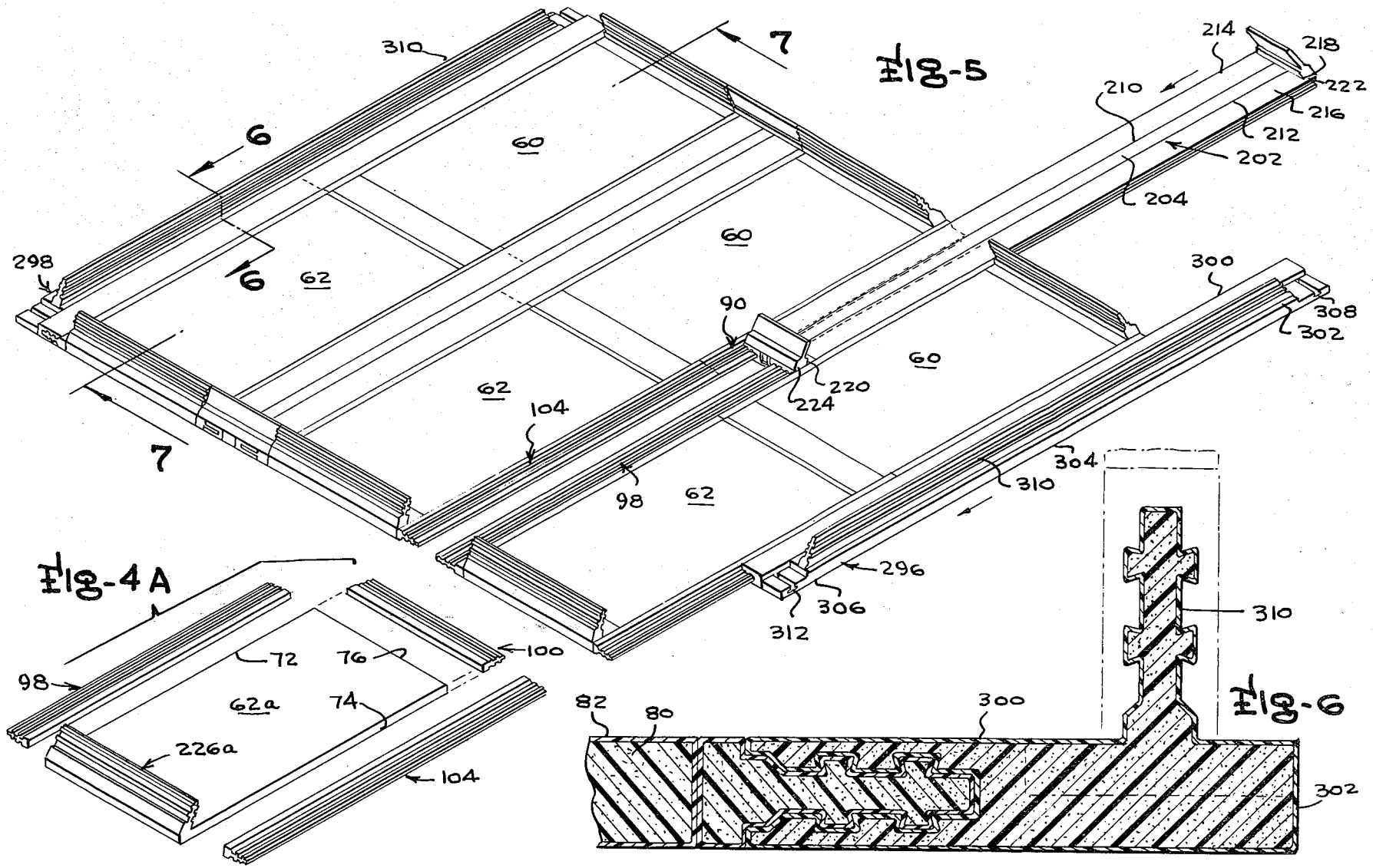
FIG. 4A is a disassembled perspective view showing an altered form of floor panel in which the end connector thereof is integral in construction.
FIG. 5 is another isometric view disclosing the floor assembly as nearly completed.
FIG. 6 is an enlarged sectional view taken on line 6—6 of FIG. 5, looking in the direction of the arrows.

The components of the floor assembly of this form of the invention are shown in FIGS. 2–8. Such components comprise a series of sets of panels, 60 and 62, which are identical to one another in construction and dimension, but differently oriented in use. Each panel is substantially rectangular in form, and the panels 60 have side edges 64, 66, and end edges 68, 70, while the panels 62 have side edges 72, 74 and end edges 76, 78. The panels, as shown in FIG. 6, include a core 80 of polyurethane or like material, with a shell or casing 82 of rigid material, such as fiber glass. Of like structure are the connecting means for the panels which essentially comprise a series of interfitting components arranged for slidable interengagement as hereinafter described.

Secured, as by a mastic bond, to the side edges 64 are elongated male connectors 84. Such connectors extend from the edges 68 and 70 of the panels 60 by a length substantially equal to the width of the connectors, whereby the ends of the connectors 84 are co-terminus with the outer edges of male connectors 86 secured to the edges 68, and with the outer edges of a female connector 88 on the edge 70. Another male connector 90 is affixed to the side edge 66 of the panel, and is terminated at one end in alignment with the outer edge of the male connector 86, while its other end 92 is spaced inwardly from the terminus of the edge 66, thereby defining, with the remainder of the edge and with the end 94 of the female connector 88, a corner slot 96.

The panels 62 are fitted with a series of male connectors which complement those of the panels 60. Secured by bonding to the side edges 72 are male connectors 98 which extend from the edge 76 to a distance beyond the edge 78 and substantially equal to the width of a connector. A male connector 100 is secured to the edge 76, between the edges 72 and 74 and a male connector of equal length extends along the edge 78. An elongated male connector 104 is mounted on the side edge 74. In the case of the latter connector, it will be noted that the length is such that it extends from the outer edge of the connector 102 to a point beyond the edge of the connector 100.

Figures 2, 3, 4:
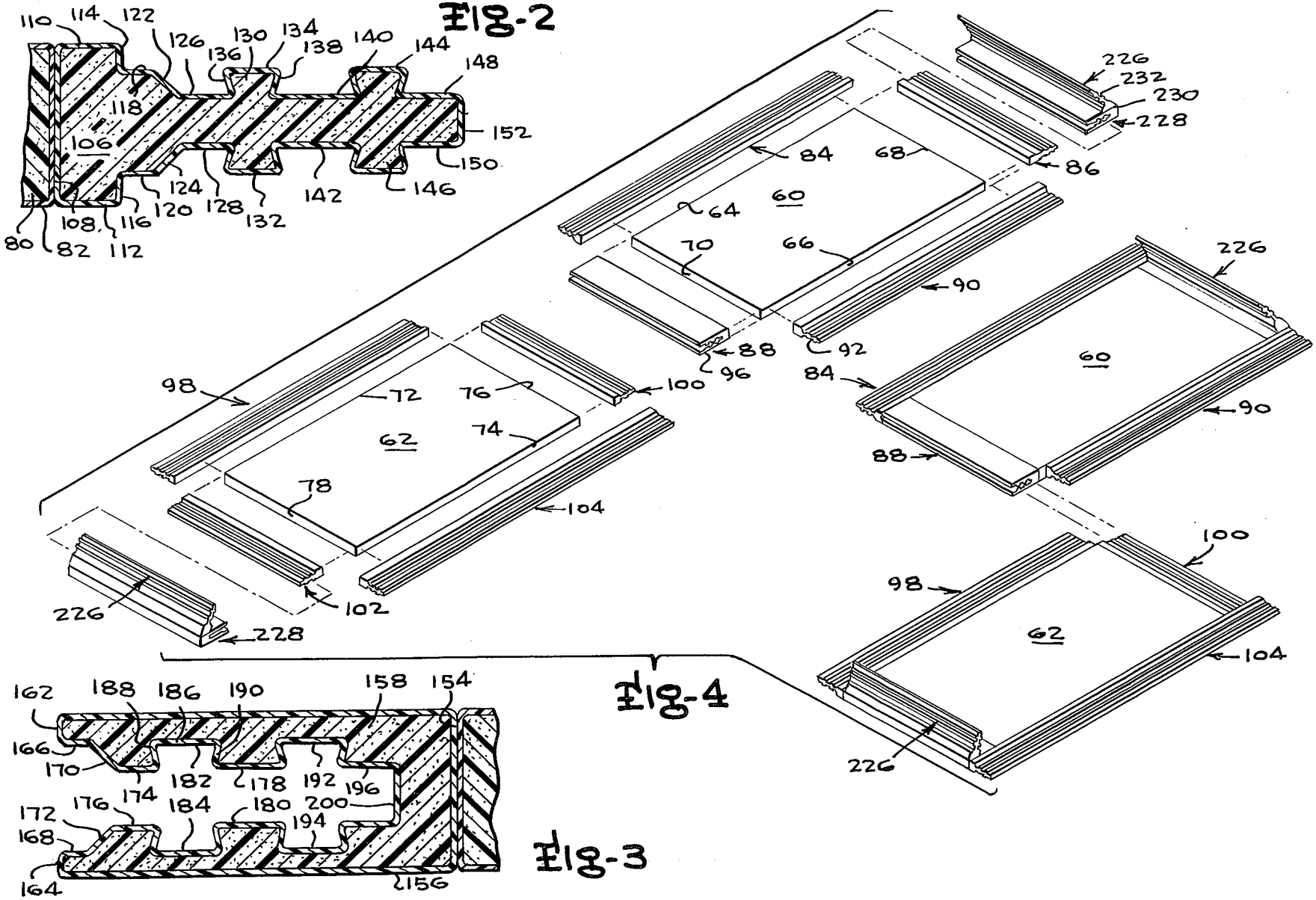
FIG. 2 is an enlarged, end elevational view of a typical panel and male connector hereof.
FIG. 3 is a view similar to FIG. 2 showing a typical female connector.
FIG. 4 is a perspective view in disassembled form of a floor layout showing two sets of floor panels.

In FIGS. 2, 3 and 6, the details of the typical connectors are shown in better detail. Referring initially to the male connectors, all of which are the same in cross-sectional appearance and structure except for the connectors 86 and 102, it will be noted that each has a polyurethane core 106 with a surrounding shell formed of fiber glass or similar material. Structurally, the male connectors comprise a flat base 108 which is attached by mastic or other known bonding means to the adjacent edge of the panel. Extending from the base are side walls 110, 112 which have abutment flanges 114, 116, extending inwardly in substantially parallel relation to the base 108. Walls 118, 120 extend perpendicularly from the flanges, and slant walls 122, 124 converge inwardly therefrom. From the slant walls, parallel first wall sections 126, 128 extend. Oppositely outwardly extending protrusions 130, 132 are similarly configured, each having an outer wall 134 substantially parallel to and spaced outwardly of the respective walls 126 and 128, and inwardly convergent side walls 136, 138. Parallel second wall sections 140, 142 extend from the first protrusions to second protrusions 144, 146 which are substantially identical to the first protrusions. The male connectors terminate in third wall sections 148, 150 connected by a distal end wall 152. It will thus be observed that the male connectors comprise elongated components having a series of protrusions of keystone-like form projecting therefrom.

For mating, slidable engagements with the male connectors, the female connectors are oppositely shaped. FIG. 3 presents an enlarged typical cross section wherein it will be observed that the female connectors are of elongated substantially rectangular form, having an inside end wall 154 which is bonded to the adjacent panel edge. Like the other components before described, the female connectors have an outer shell 156 of fiber glass, and an inner core 158 of polyurethane or other insulating filler. Extending from the inside end wall 154 are parallel side walls 158, 160 spaced apart a distance such that the female connector is equivalent in thickness to the panels. Outer end walls 162, 164 and parallel inward walls 166, 168 define the extremity of the female connector, with slant walls 170, 172 converging inwardly therefrom. First female wall sections 174, 176 are substantially parallel to one another, and are spaced from second female wall sections 178, 180 by first depressed sections 182, 184. The latter are identical but opposite, each having a base 186 and angular sides 188, 190. Inboard of the second female wall sections are second depressed sections 192, 194 identical to the first depressed sections. From these extend third female wall sections 196, 198 joined by a terminal wall 200.

Reference is directed to FIG. 6, showing the assembled status of a typical male and female connector. The components are joined in sidewise, sliding fashion, with the protrusions 144, 146 and 130, 132 of the male connectors captively engaged in the depressed sections 192, 194 and 182, 184, respectively, of the female connectors. Thus joined, the outer end walls 162 and 164 of the female connectors abut the flanges 114, 116 of the male connectors, in the relationship shown. This union between the components produces a joint which is substantially vapor proof and is extremely resistant to passage of any fluid or gaseous media therebetween.

In the illustrated embodiment, the structure floor comprises three sets of joined panel sets, each set having a panel 60 and a panel 62. FIG. 5 shows the means whereby the sets of panels are interconnected to provide a flat floor for the structure. As will be noted, the joined sets, after assembly, each present substantially a continuous male connector at either side thereof (composed of male connectors 84 and 98 at one side and connectors 90 and 104 at the other side). In order to connect the sets, elongated lateral floor strips 202 are provided. Each of these, here they are two in number, comprises a central number 204 comprising a rectangular form 206 of fiber glass or the like having a core 208 containing polyurethane filler. Bonded permanently to the lateral sides 210, 212 of the form 206 are female connectors 214, 216 respectively, Which extend the full length of the latter. As shown in the drawing, after the lateral female connectors are bonded to the sides of the central member, end male connectors 218 and 220 are bonded to the upper end surfaces of the assembly. These end male connectors are similar in form to the typical male connectors except for the elimination of the projections thereon and the shape of the bases thereof. The bases 222, 224 are so formed as to abut the male connectors inwardly at a pre-selected angle, for a purpose appearing in more detail below.

Referring again to FIG. 5, the joining of the sets of floor panels by means of the lateral floor strips is there shown. The sets of male connectors 90 and 104 are slidably inserted in the adjacent female connectors 214, and the sets of male connectors 98 and 84 are received in the adjacent female connector 212.

Figures 7, 8:
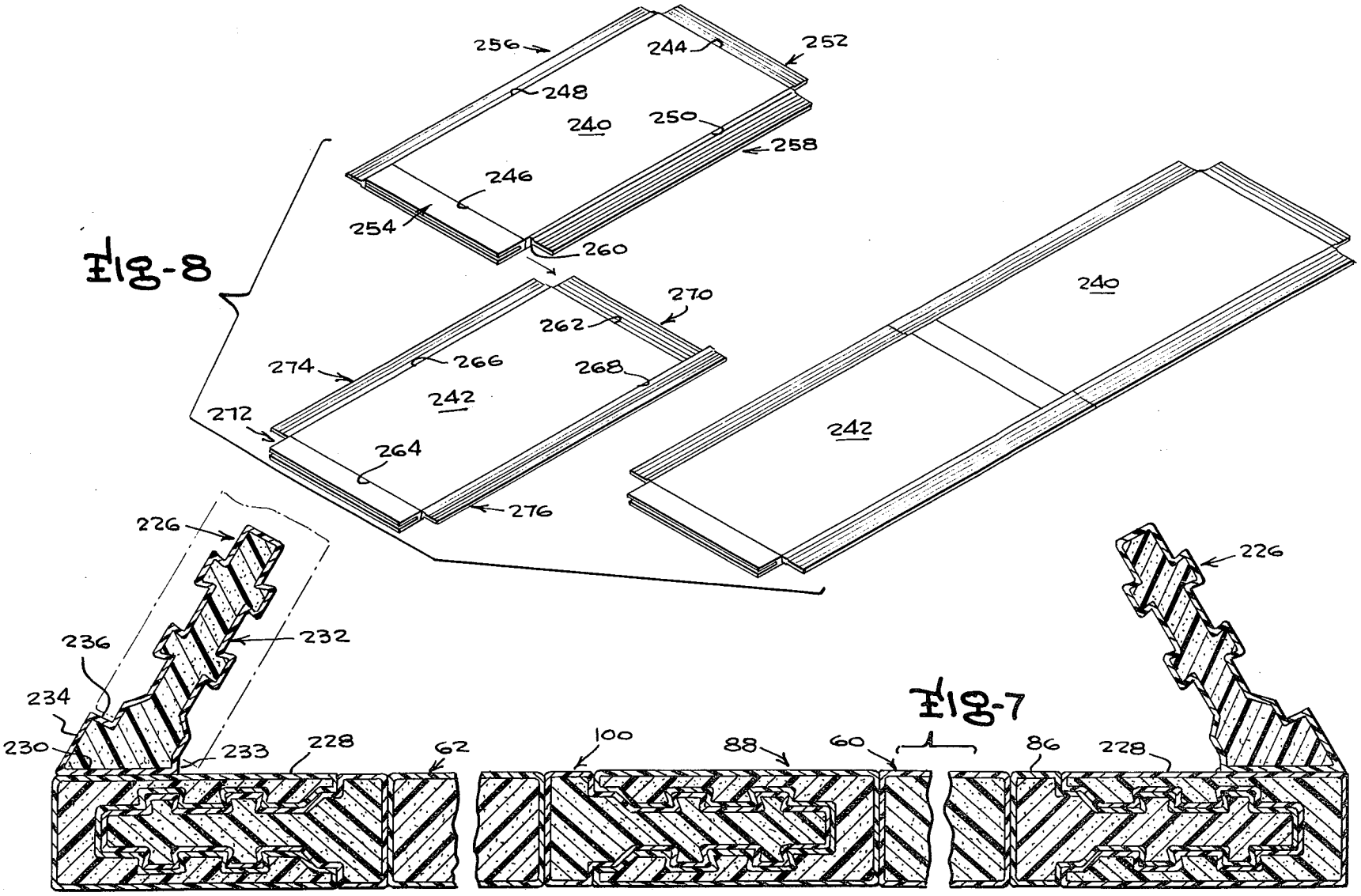
FIG. 7 is a foreshortened sectional view showing details of the floor assembly, along line 7—7 of FIG. 5, looking in the direction of the arrows.
FIG. 8 is a perspective view showing various components of a side wall assembly hereof.

A male side connector 226 is attached to the end male connectors 86 and 102 of the assembled panel sets (FIG. 4). Such connectors each comprises a female connector section 228 identical to the before described female connectors and of a length suitable for connection on the male connectors 86 and 102 at an appropriate stage during assembly. Secured fixedly on the upper end of such female connectors are the bases 230 of angle male connector elements 232 (FIG. 7). A short inner wall 233 projects perpendicularly from the section 228, and an outer angle wall 234 of substantially greater width is inclined toward the short inner wall. A ledge 236 is disposed from the wall 234 toward the wall 233 and serves as the inner abutment of the angle male connector. The remainder of the side connection 236 is the same as the typical male connectors described above.

In FIG. 4A a floor panel 62*a* is shown wherein the male side connector 226*a* is formed as an integral part of the panel. If desired, the various connectors may also be integrally formed with the panel 62*a* at the time of original manufacture, which procedure eliminates the need for mastic bonds.

Figures 8, 9:
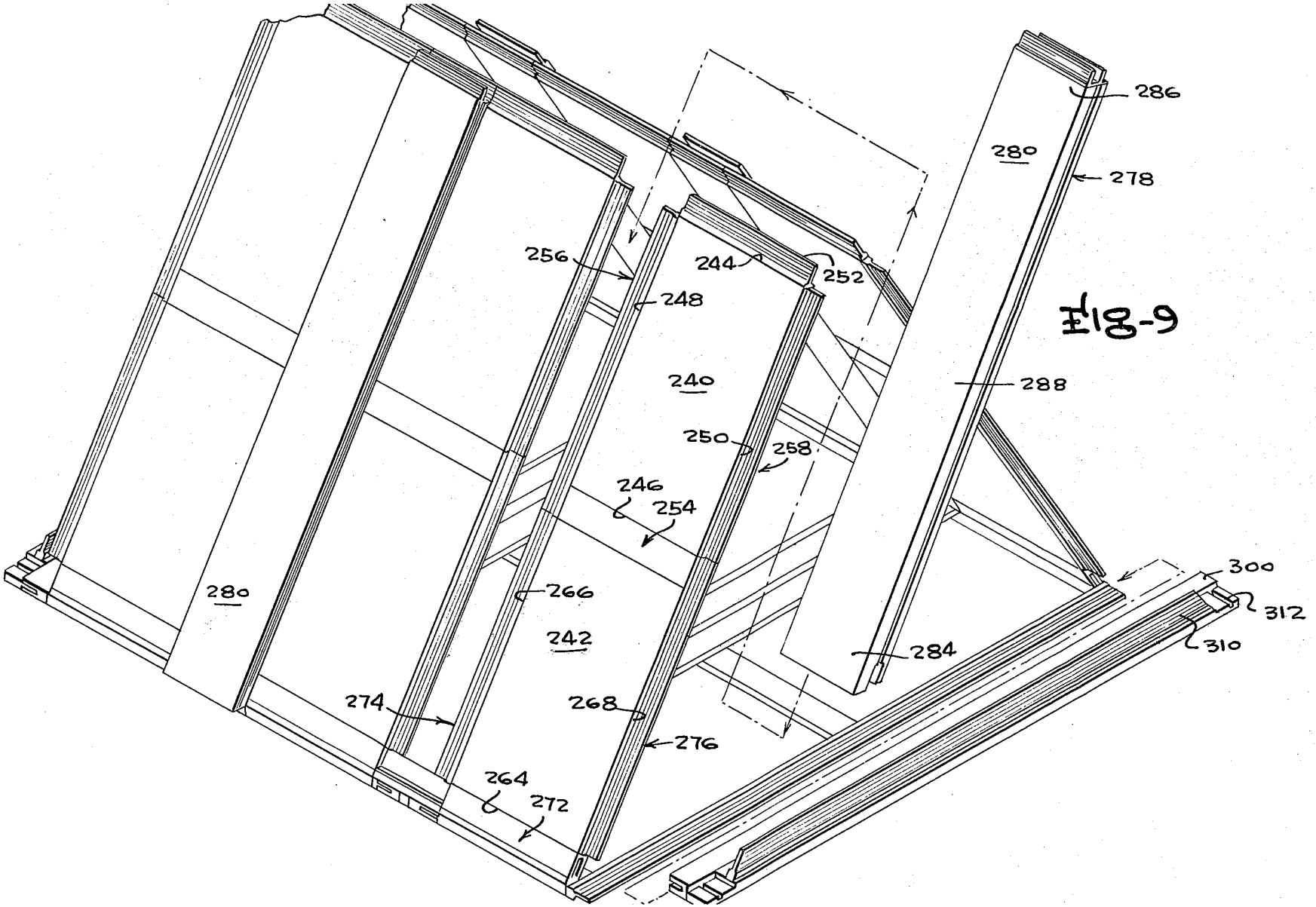
FIG. 9 is a disassembled perspective view showing a partially completed floor and side wall assembly.

The inclined side walls of the structure are disclosed in FIGS. 8 and 9 of the drawing. This assembly is somewhat similar, except for dimension and detail, to that of the floor assembly. The inclined walls are formed of sets of upper and lower panels 240 and 242. Each of the upper panels has a top edge 244, a bottom edge 246 and opposite lateral edges 248 and 250. Fixedly secured to the top edge 244 and coextensive in length therewith is a typical male connector 252, while the edge 246 has a similarly dimensioned female connector 254. Extending in length from the outer side of the connector 254 to the edge 244 along the lateral edge 248 is a male connector 256. Secured to the edge 250 is a male connector 258 extending from the edge 244 to a location inwardly of the edge 246, thereby forming a corner slot 260. The lower panels 242 have upper and lower edges 262, 264 and lateral edges 266, 268. Fixed on the upper edge 262 of each is a male connector 270 of equivalent length, and the lower edge 264 has a female connector 272. The side edge 266 carries a male connector 274, while the side edge 268 has an elongated male connector 276. The connector 276 is of a length to occupy the slot 260 when in place.

The panels 240 and 242 are assembled in sets with the male connectors 270 interfitted with the female connectors 254. This brings the male connectors 256 and 274 into alignment and also the connectors 258 and 276 are mutually aligned.

The panels of the inclined wall system are adapted for interconnection with the floor system and with one another, in the manner illustrated in FIG. 9. The sets of panels 240, 242, here three in number for each inclined wall of the structure, are joined in the respective side assemblies by two inside inclined beams 278. The beams, like other structural components of the building are formed with an outer layer 280 of rigid fiber glass material, and a core 282 of polyurethane. The beams are of a length substantially equal to the combined lengths of the panels 240 and 242 when assembled, but as shown in FIG. 1, are substantially of greater thickness than such panels in order to increase the strength of the structure at the beam positions. Each beam has a lower end section 284, and upper end section 286, and a main extent 288 intermediate said sections. As shown, the upper end section 286 comprises a pair of typical male connectors, one of which is outwardly offset in assembly location from the male connectors 252 of the panels 240. The lower end sections 284, (see FIG. 15), comprise a component formed to overlap and engage about the connectors 86 or 78 of the floor panels, and to such purpose, have an outer slant end wall 289, a compound chamber 290 extending from side to side and a second inner wall 292 offset from the wall 288. The chamber has a shoulder at 293, and the chamber permits the beam to overlie the male connector as shown. The main extent 288 of each of the beams has typical female connectors integrally formed therewith on each side to receive the male connector pairs 258, 276 and 256, 274 of the adjacent sets of wall panels. In the process of connection of an assembled wall section on a completed floor, the lower female connectors 272 engage on the floor connectors 102 and 220 (or 86 and 218), with the beam chambers 290 extending thereover.

The floor assembly (FIGS. 5 and 9) when assembled, includes end support members 296 and 298 secured at opposite ends thereof. These end support members each have an elongated typical female connector 300 extending the full length thereof, and slidably engaged on the outside male connector pairs 84, 98 and 90, 104 of the outer floor panels. To each of the female connectors 300 is bonded a horizontal base 302 having a central portion 304 and sides 306, 308. Projecting upwardly from the central portions 304 are male connectors 310, while the sides have slots 312 formed therein extending transversely inwardly with relation to the connector 310, for a purpose appearing below.

Figure 11:
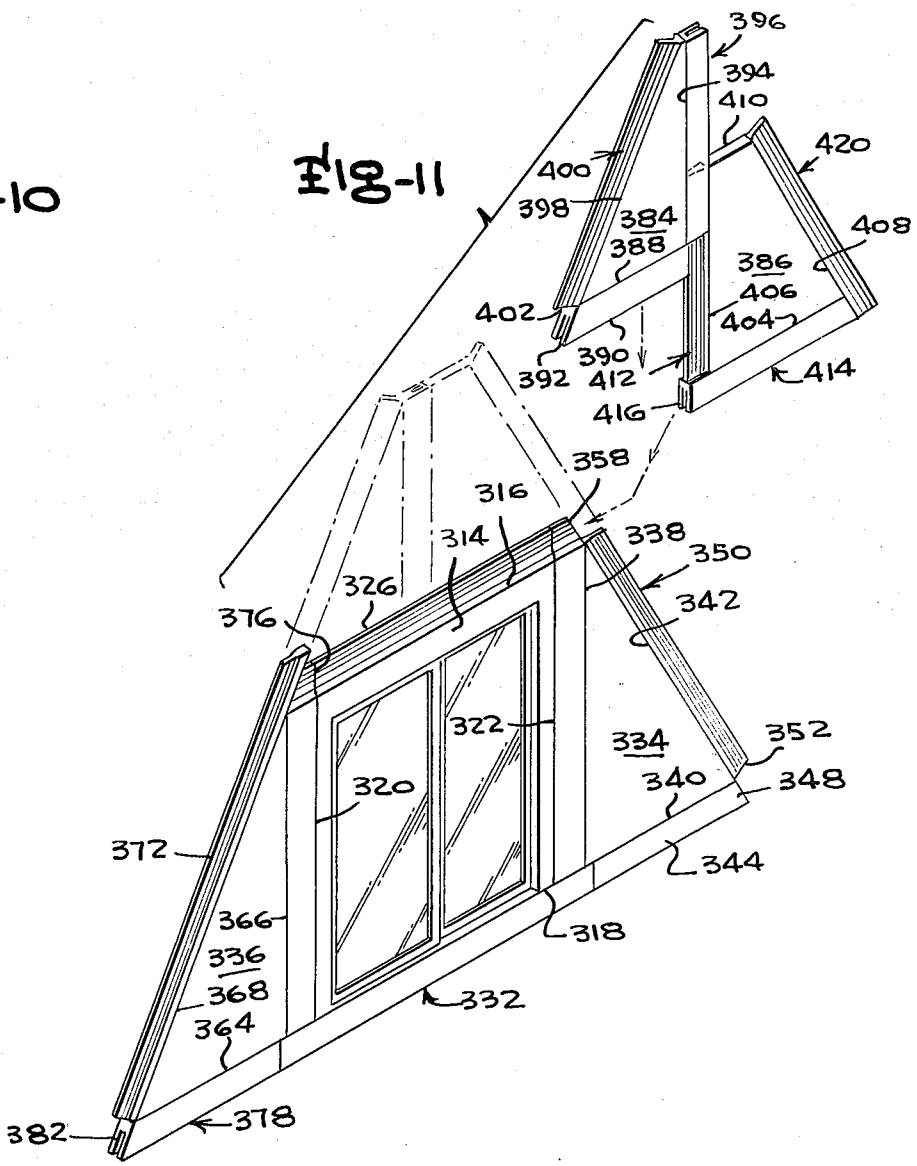
FIG. 11 discloses further advanced end wall assembly.
Figure 10:
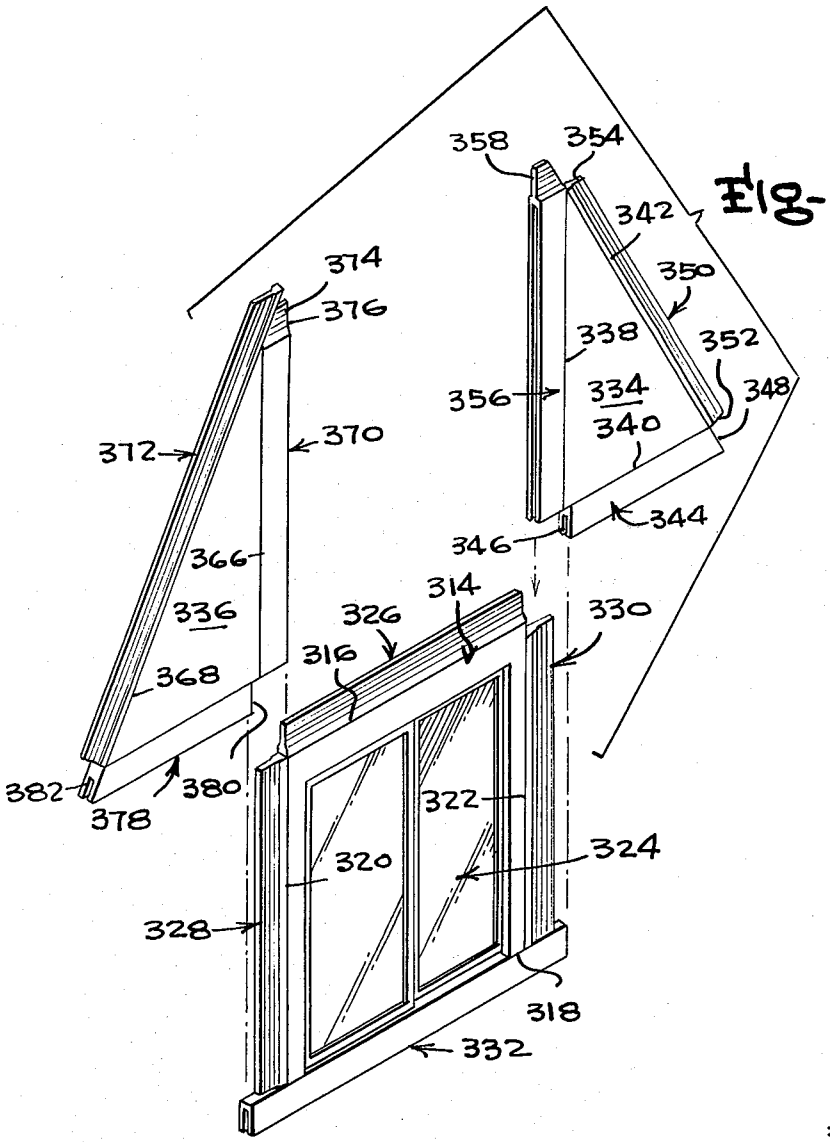
FIG. 10 is a perspective view showing unassembled components of an end wall hereof.
Figure 12:
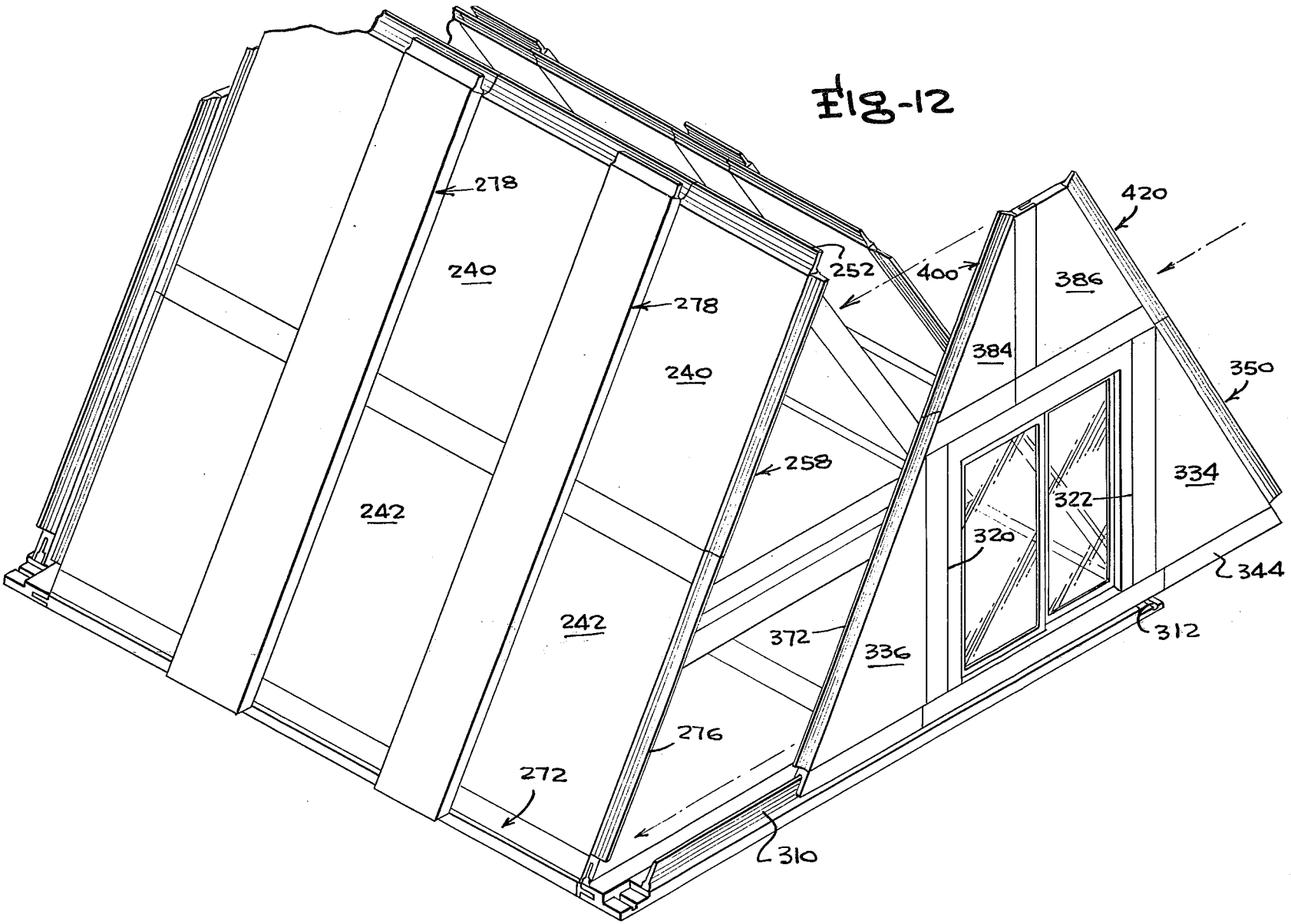
FIG. 12 is a view similar to FIG. 9 but showing the end wall in application to a completed floor and side wall.

FIGS. 10–12 show the structure and assembly of the end walls of the A-frame unit. The end walls are of course, two in number, but each is the same and a description of one will suffice for both. A central end panel 314 has upper and lower ends 316, 318, and sides 320, 322. The panel 314 is formed in the same structural fashion as the other components, but incorporates a door or window assembly 324 of optional form. Secured fixedly to the upper end 316 is a typical male connector 326 which extends between the sides 320 and 322. Similarly, each of said sides has a typical male connector 328 and 330. Fixed to the lower end 318 is an elongated female connector 332 which projects outwardly a substantial distance from each of the sides.

Two side panels 334 and 336 are provided and are similar but not identical. The panel 334 has a vertical side 338, a base 340 and an angle side 342. The base 340 has a female connector 344 thereon with a first end 346 which is spaced inwardly from the vertical side 338, and a second end 348 which is outwardly inclined in alignment with the inclination of the side 342. A male connector 350 is secured to the side 342 and has specially configured ends 352, 354, the latter being perpendicular to the general extent of the side 338. On the side 338 is an elongated female connector 356 which is substantially coextensive in length with said side, and has a rectangular recess 358 in one upper end thereof. As shown in FIG. 11, the panel 334 connects to the central end panel 314 by slidable engagement of the male and female connectors 330 and 356. When thus assembled, a small male connector 360 is secured to the side panel by a lug 362 which seats in the recess 358 — the male connector 360 and the lug being aligned with a connector 376, detailed below.

The opposite side panels 336 each has a base side 364, a vertical side 366, and a slant outer side 368. A female connector 370 coextensive in length with the vertical side 366 is bonded thereto, while the slant outer side 368 has an elongated male connector 372, the upper end 374 of which projects upwardly a substantial distance above the panel to serve as an end abutment in the further assembly of the end walls.

Disposed above the connector 370 and adjacent to connector 372 is another short male connector 376 which aligns with the connectors 326 and 360 during assembly. A female connector 378 on the base 364 has an end 380 spaced inwardly from the vertical side 366, and an angular outer end 382 aligned with the side 368.

Figure 15:
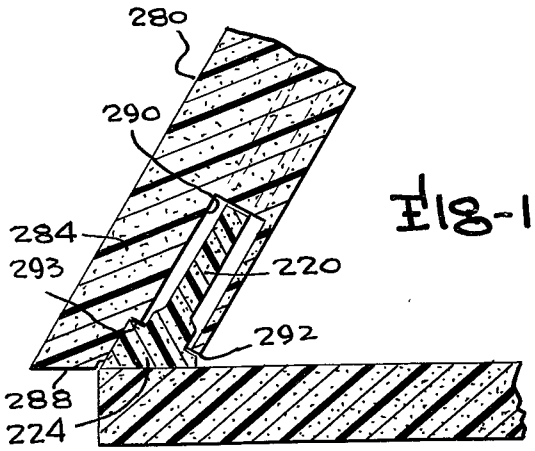
FIG. 15 is an enlarged detail cross-section on line 15—15 of FIG. 13, looking in the direction of the arrows.

FIG. 11 shows the additional top end wall panels 384 and 386 thereof. The panel 384 has a base side 388 which carries a female connector 390 having an angular outer end 392, and a vertical side 394 with a female connector 396 of similar extent, and a slant outer side 398 with a male connector 400. The lower end 402 of the connector 400 is spaced upwardly from the base 388 and is substantially parallel thereto. The panel 386 in plan form comprises a truncated triangle, and has a base side 404, a vertical inner side 406 and a slant outer side 408, and a top 410. The inner side 406 carries a typical male connector 412 which engages with the female connector 396 of the adjacent panel. The base side 404 has a female connector 414 extending outwardly therefrom at the side 406 and terminating in alignment with the connector 412 at one end 416 thereof. The opposite end 418 of the connector 414 is bonded to a male connector 420 on the slant side 408. In FIG. 15, the panels 384 and 386 are assembled and the coaligned female connectors 390 and 414 are shown being engaged on the aligned male connectors 360, 326 and 376. This results in an interlocked assembly, as the lower portion of the outside slant wall 398 of the panel 384 abuts the upper end 374 of the connector 372.

Figure 13:
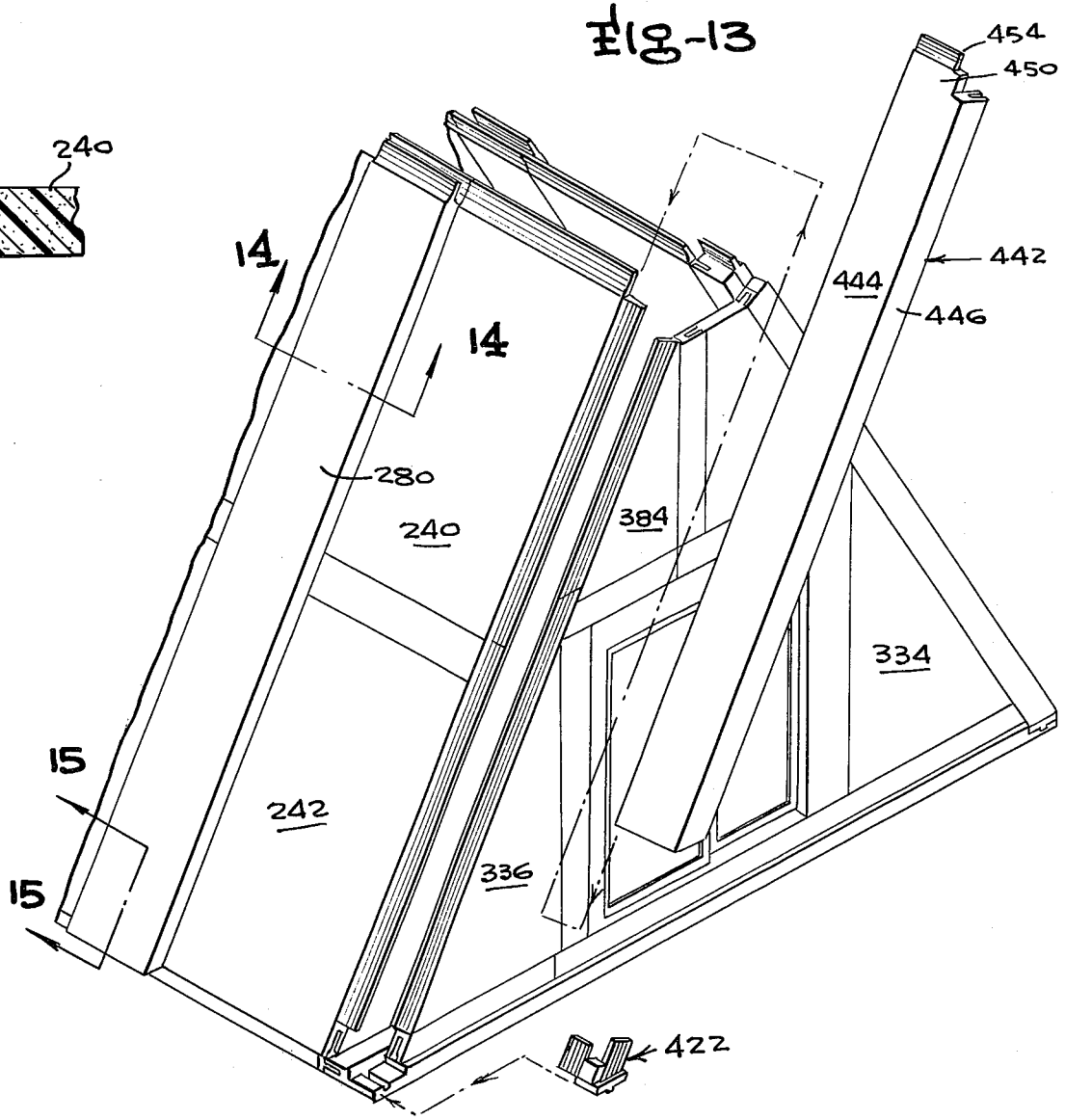
FIG. 13 is a partial perspective view of a corner of the structure showing a corner beam and corner plug in disassembled form.
Figure 14:
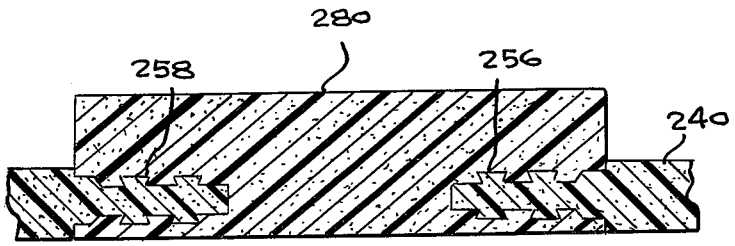
FIG. 14 is an enlarged sectional view showing details taken substantially on line 14—14 of FIG. 13, looking in the direction of the arrows.
Figure 20:
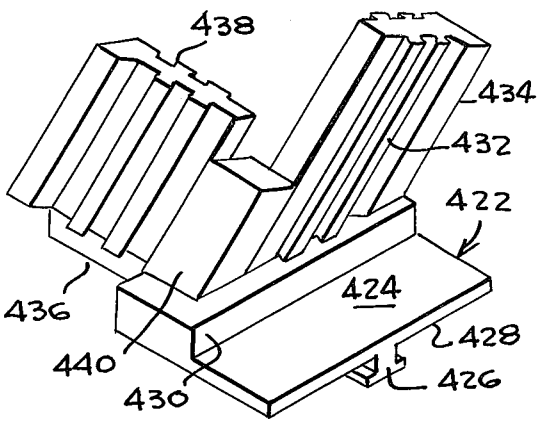
FIG. 20 is a perspective view of one of the corner plugs hereof.

The next stage of assembly is developed in FIGS. 12, 13 and 15. At this point, the assembled end walls are slidably engaged on the floor structure via interengagement of the female connectors 378, 332 and 334 on the connectors 310 of the horizontal base 302. With the side and end wall assembly thus engaged with the floor, a corner plug 422 (FIGS. 13 and 20) is employed for the dual purpose of completing the connectors at the corners and to interlock the assembly. The corner plugs 422 each comprises a flat body portion 424 having a rail 426 depending from the lower side 428 thereof. A block portion 430 has a slant section 432 projecting therefrom carrying an extension 434 which aligns with the male connector when the rail 426 is engaged in the slot 312. An extension 436 of the block portion 430 also carries a short connector 438 which aligns with the outside male connectors 274 and 276 of the side wall panels. At the corner formed by the members 432 and 438, a corner slant block 440 is positioned.

Figure 17:
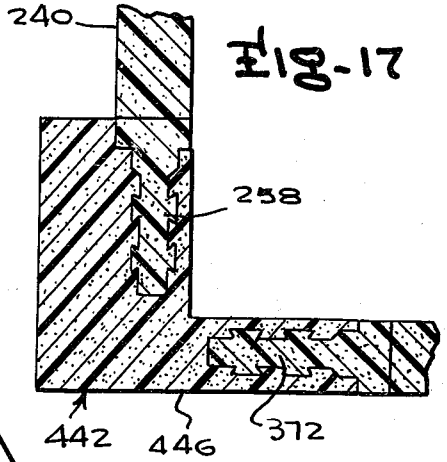
FIG. 17 is an enlarged cross-sectional view showing details of a corner beam, taken on line 17—17 of FIG. 16, looking in the direction of the arrows.
Figure 16:
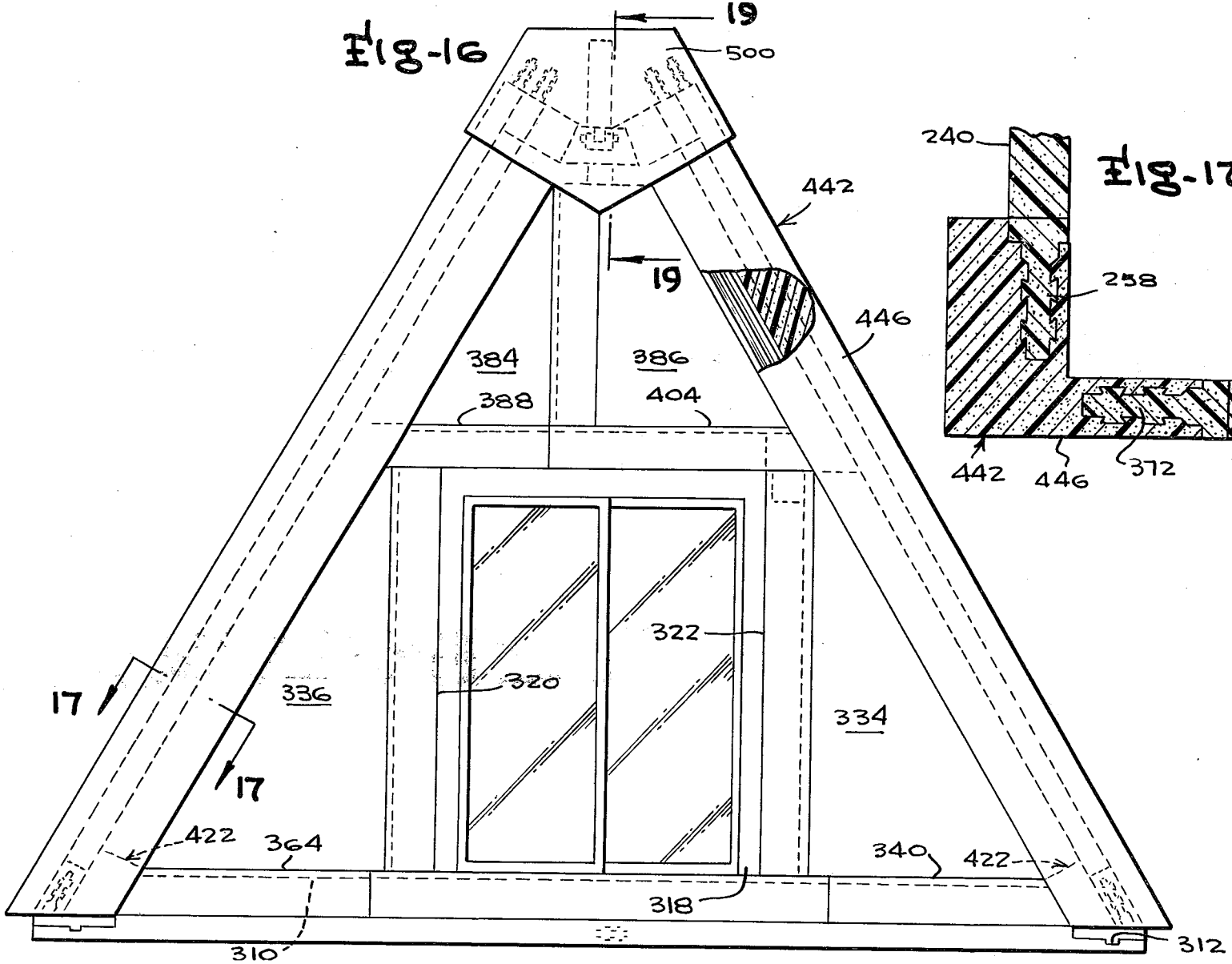
FIG. 16 is an end elevational view of a completed unit, partially broken away.
Figure 19:
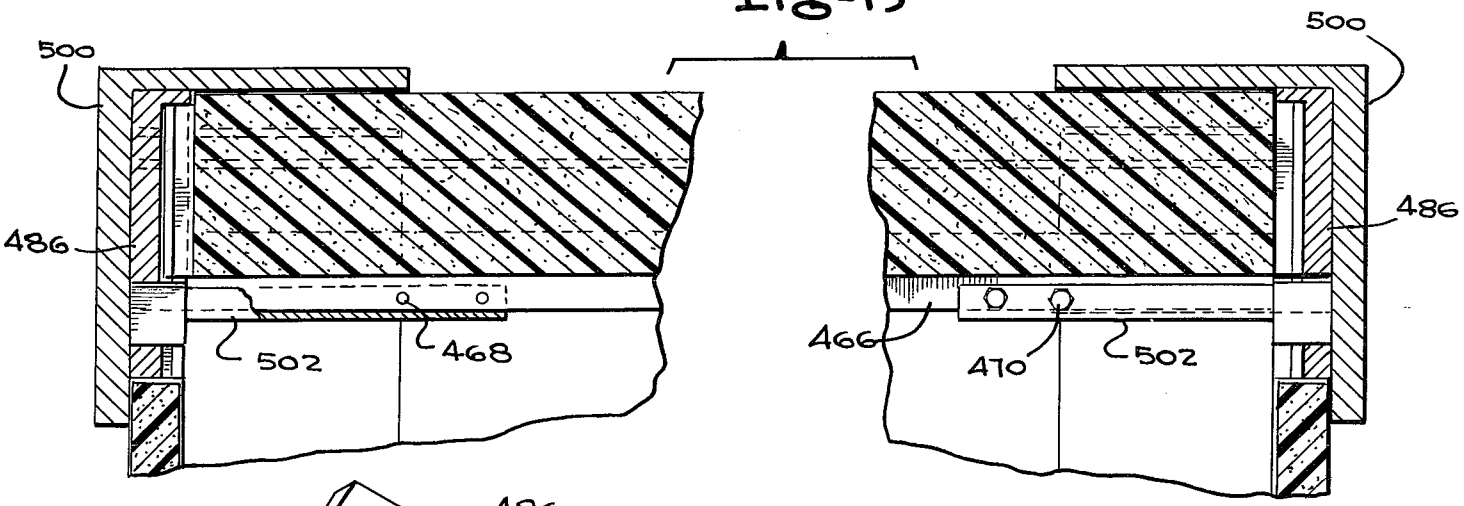
FIG. 19 is a foreshortened sectional view on enlarged scale of the ridge pole assembly, taken on line 19—19 of FIG. 16, looking in the direction of the arrows.

FIGS. 13, 16 and 17 disclose the manner in which the corners of the structure are finished by the installation of corner beams 442. The corner beams, four in number, each has a side component 444 and an end component 446 which extends from a lower end 448. The end components 446 terminate at a top edge 450 which extends angularly upwardly from the top edge 410 of the panel 386 or the connector 396 of the panel 384 when in place, and the upper end portions 452 of the side components 444 are elongated by comparison therewith and carry a male connector 454. As seen in the drawings, the components 444 have a compound channel 456 therein which constitutes a female connector, and the components 446 have an identical chamber 458 constituting also a female connector.

The corner beams are engaged on the male connectors on the side wall panels 336, 384 and 334, 386 by engagement of the male connectors thereof within the chamber 458 of the components 444. Similarly, and at the same time, the side wall panels 240, 242 are engaged by interconnection of the respective outer male connectors thereof in the chambers 456 of the components 446.

The upper male connector 454 of the component 444 is longitudinally aligned with the connector 286 of the inclined inside beam 278. Laterally aligned on an inclined angle with these sets of male connectors are the upper male connectors 252 of the side wall panels. This provides a pair of inclined male connectors on each side of the structure.

Figure 18:
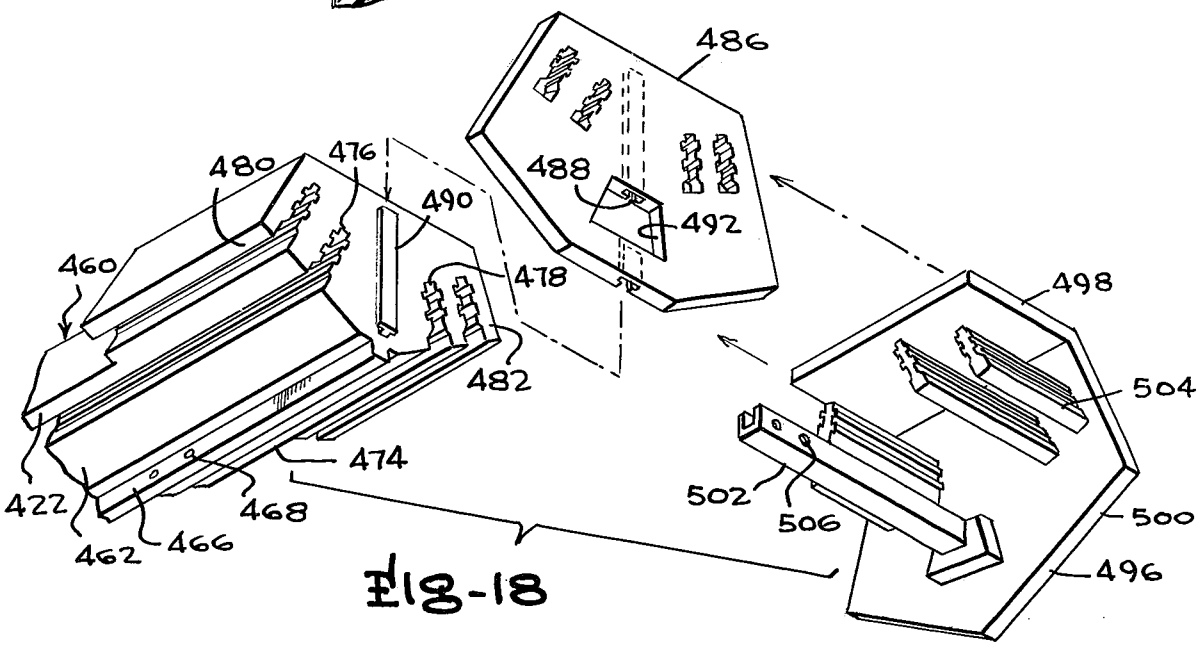
FIG. 18 is a disassembled perspective view of an end of the main ridge pole assembly hereof.

A major structural feature of the invention is a main ridge pole 460 (FIG. 18) which has a central portion 462 of substantially triangular form with an outwardly extending top 464. A depending tab 466 extends the full length of the pole, and has apertures 468, 470 therein adjacent the pole ends. Outer end walls 472, 474 depend from the top and define, with the adjacent walls of the central portion, inner female connectors 476, 478. Such connectors are slidably engaged on the male connectors 252 of the side wall panels.

Affixed to the outer wall 472, 474 at spaced locations are auxiliary female connectors 480, 482 which are engaged with the male connectors 454 and 286 to interlock the entire structure into a substantially completed form.

End seals 484, 486 have a compound, keyhole slot 488 therein to receive a complementary lug 490 on the ends of the ridge pole. The seals also have a transverse opening 492. It will be observed that the end seals vertically slidably engage on the lug from above.

End caps 496 have a top plate 498, a vertical outer plate 500 shaped to cover the space existing at the ends of the structure, a bifurcated inner leg 502, and four male connectors 504. The end caps extend through the seal slots 492, 494 and into the adjacent connectors of the structure, with the leg 502 extending on opposite sides of the lug 466 of the ridge pole. The leg 502 has openings 506 therein aligned with the apertures 468, 470 and conventional fasteners, such as bolts or the like, are extended through the aligned openings to lock the entire structure in place.

Figure 22:
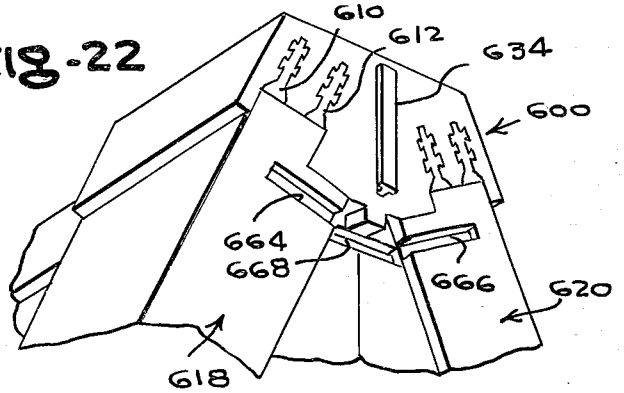
FIG. 22 is an end perspective view of the alternate form of cap with the corner beam in place, but with the seal member and cover thereof removed for illustration of details.
Figure 21:
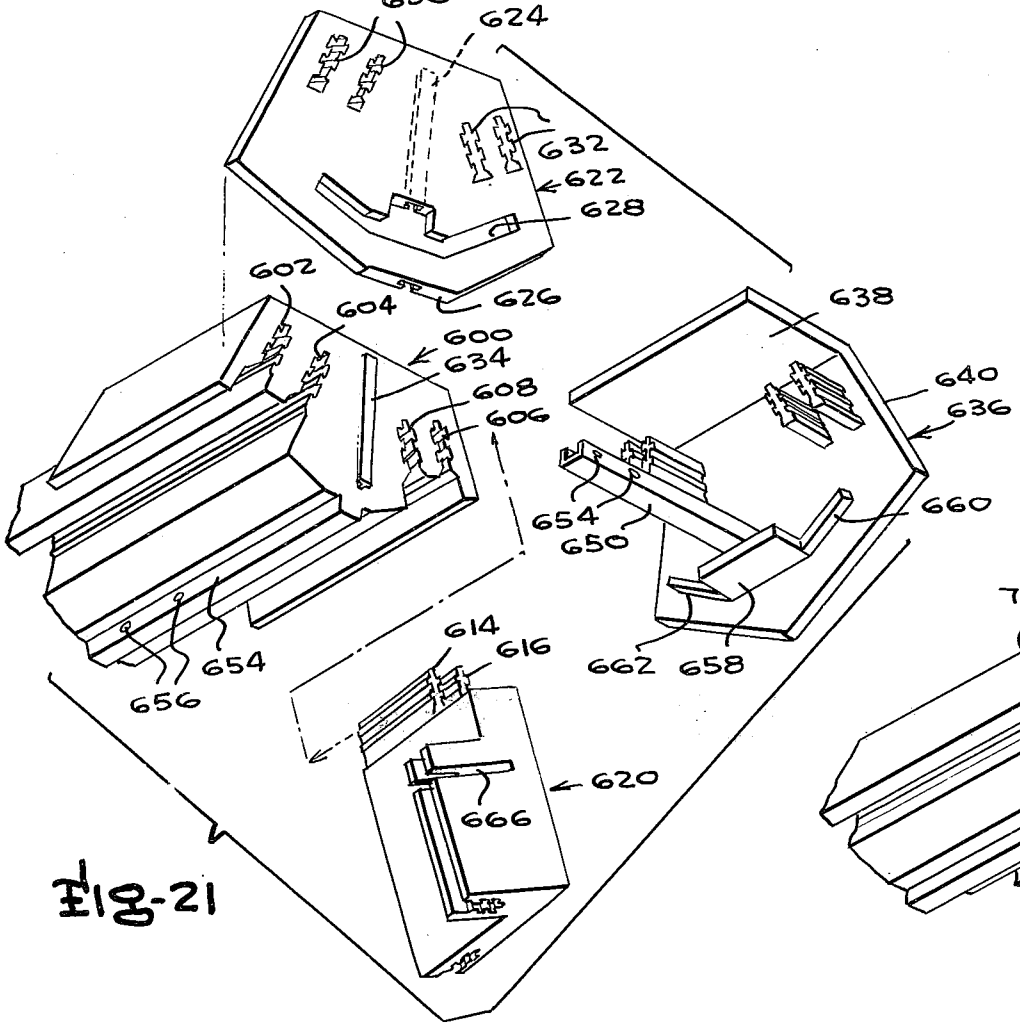
FIG. 21 is an exploded perspective view showing an alternate form of end cap of the invention.

FIGS. 21 and 22 show a first alternate form of ridge pole 600. Here, the pole includes keyways 602, 604 and 606, 608 which interfit with male connectors 610, 612 and 614, 616, respectively, extending from corner beams 618 and 620. It will be noted that these connectors are inwardly spaced from the ends of the corner beams. An end seal 622 has a vertical T-slot 624 formed therein opening on its lower edge 626. The slot is interrupted by a compound central opening 628. The seal also has openings 630, 632 to accommodate male connectors.

The seal 622 is slidably engaged on the end of the connector by engagement of the T-slot 624 on a T-bar 634 thereof.

An end cap 636 has a top plate 638 and front plate 640. Male connectors 642, 644 and 646, 648 extend from the inside surface of the front plate, through the openings 630 and 632 and into the keyways 602–608, respectively. A bifurcated tongue 650 extends from the plate 640, through the opening 628 and straddles a lower extension 652 of the ridge pole. The tongue has openings 654 which are aligned with openings 656 in the extension, and fasteners (not shown) are extended therethrough to effect fixed connection. A base member 658 with side wings 660 and 662 also projects inwardly from the front plate. These extend through the openings 628, the wings engaging in slots 664, 666 in the corner beams and the base plate, which is elongated, seating in a slot 668 in the end walls.

Figure 23:
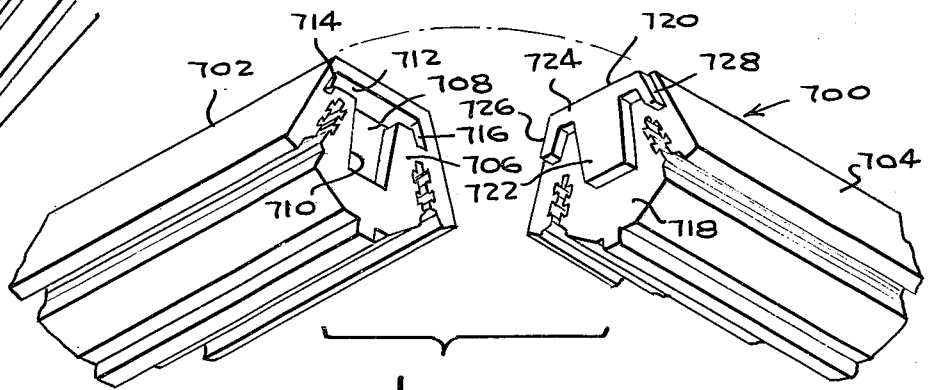
FIG. 23 is a disassembled perspective view of another alternate form of ridge beam showing a center connection means thereof.
Figure 24:
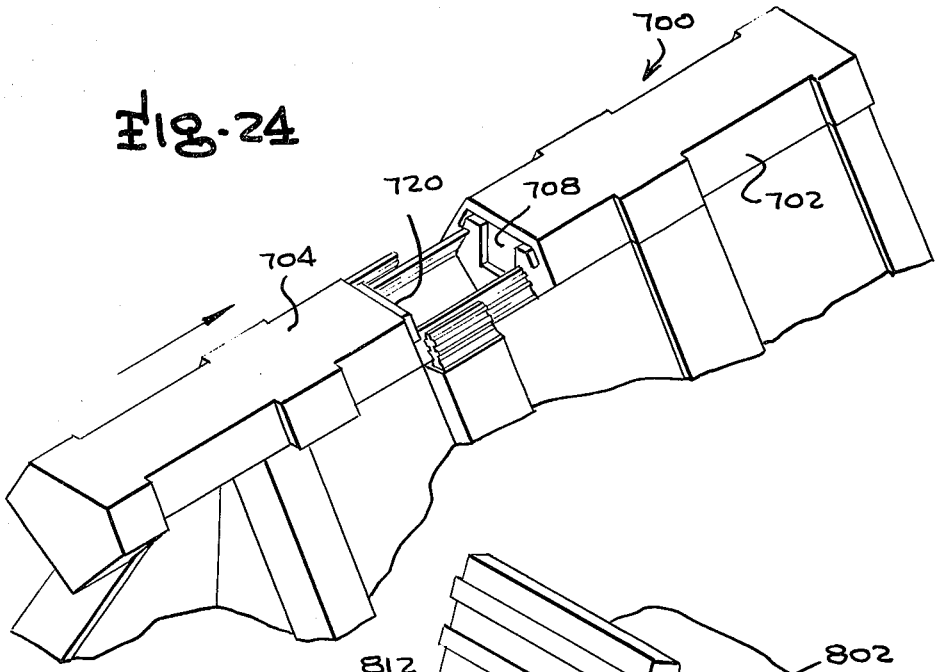
FIG. 24 is a perspective view showing the alternate ridge beam of FIG. 23 in the process of installation.

FIGS. 23 and 24 show still another alternate ridge pole structure. Here, the pole end structure is unitary. The pole 700 is formed in sections 702, 704 here shown as two in number although the number of sections is a function of the length of the structure and is therefore variable. The pole section 704 has an interior end 706 with a lock chamber 708 therein. The lock chamber preferably has a generally rectangular main portion 710, a top cross section 712 and angular side branches 714, 716. In complementary fashion, the section 704 has an interior end 718 with a locking key member 720 shaped for frictional engagement in the chamber 708. The key member includes a central block 722, a cross pin 724 and angular branches 726, 728. Assembly is shown in FIG. 24.

Figure 25:
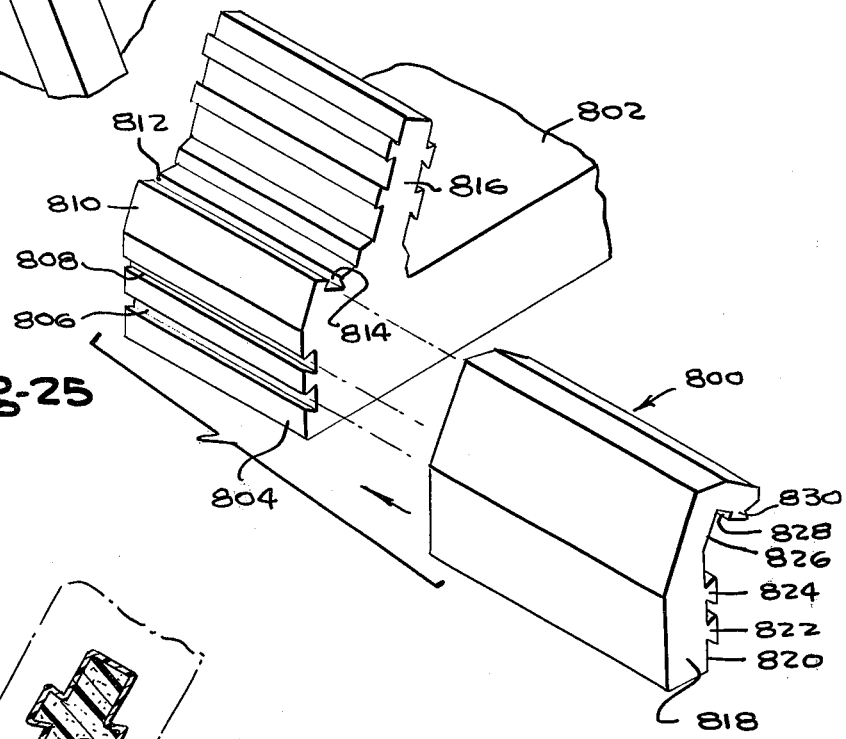
FIG. 25 is an enlarged, disassembled perspective view of an alternate connection for the floor panel connection.
Figure 26:
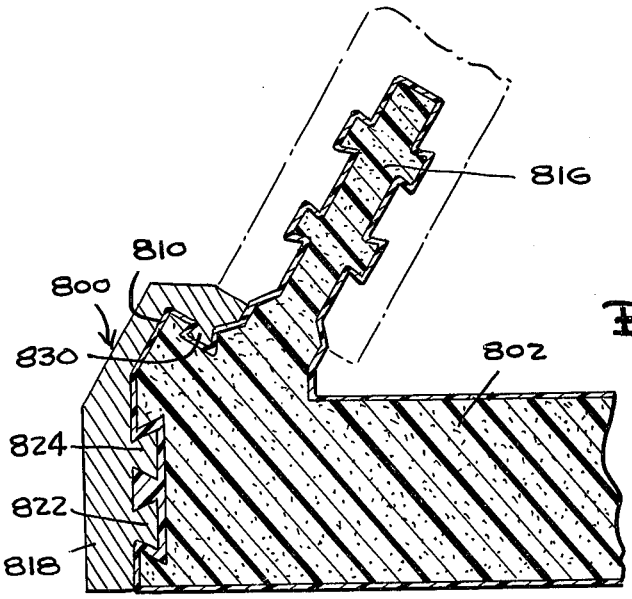
FIG. 26 is an enlarged sectional view through a section of the floor panel as shown in FIG. 25.

The floor panels may be advantageously finished by application of an outside sealer strip 800 shown in FIGS. 25 and 26. This involves a modification of the outer end of the floor panel as follows: The floor panels 802 and connectors (not shown), have outer end edges 804 in which are formed negative keystone slideways 806 and 808. Above these keyways, a slant wall 810 extends upwardly and terminates at an inwardly inclined top 812. Inboard of the top 812 is another negative keystone keyway 814 — a slant male connector 816 extending inwardly and upwardly, as previously described.

The sealer strip 800 comprises a body section 818 of a length sufficient to extend substantially the full length of the building. From the inside surface 820 thereof project male keystone members 822, 824 which slidably engage in the keyways 806 and 808. The inside surface includes a slant section 826 contacting the wall 810, a short wall 828 contacting the top 812, and another depending keystone 830 slidably mounted in the keyway 814. The outer surface of the sealer strip may be of any selected configuration.

It will be observed that the above structures, thus interlocked, can be disassembled by substantially reversing the procedure heretofore described. The floor assembly, it will be understood, is suitably anchored to a prepared building site such as a prepared earth surface, a concrete slab or a series of pilings by conventional fastening means. The structure will also, of course, incorporate suitable plumbing and electrical fixtures in accordance with the desired utilization of the structure.

I claim:

1. An integrated building structure comprising:

a floor having side connection systems and end connection systems;

end walls with base connection systems interengaged with the end connection systems of the floor, the end walls having corner connectors;

side walls with base connection systems interengaged with the side connection systems of the floor, the side walls having corner connectors and having top connectors;

corner beams, with corner connectors mating with the corner connectors of adjacent side and end walls and interengaged therewith, the corner beams having top connectors;

an elongated main ridge pole having ridge pole connectors which interfit with the top connectors of the side walls and corner beams;

each of the adjacent connectors including a male connector portion and a female connector portion;

each of said male connector portions including a base with extending side walls, abutment flanges on the side walls, converging slant walls, wall sections with a plurality of outward protrusions, and an end wall;

each of said female connector portions being slidably engaged with an adjacent male connector portion, and comprising an inside end wall, substantially parallel side walls, outer end walls, substantially parallel inward walls, slant walls, wall sections with a plurality of depressed sections thereon, and a terminal wall;

the outward protrusions of the male connectors fitting within the depressed sections of the female connectors to interlock the connectors to one another; and corner plugs interengaging the side and end walls with the floor.

2. The invention of claim 1, wherein:

each of the components of the building structure has an inner core of insulating material and an outer shell.

3. The invention of claim 1, wherein:

said inner core is polyurethane; and said outer shell is fiber glass.

4. The invention of claim 1, wherein:

said floor, side walls and end walls are sectional; and the sections of said floor, side walls and end walls are joined by male and female connectors.

5. The invention of claim 1, wherein:

the floor has a slot formed therein at its corners; and the corner plugs have rails engaged in said slots.

6. The invention of claim 1, wherein:

the top connectors of the corner beams are spaced outwardly in alignment from the top connectors of the side walls; and the ridge pole has inner and outer connectors engaging, respectively, the top connectors of the side walls and the top connectors of the corner beams.

7. An integrated building construction comprising:

A floor system having longitudinal and lateral sides anchored to support means, the floor system including a series of substantially rectangular floor panels having edges;

interlocking fastening means on the edges of the floor panels comprising interfitting male and female components slidably joined together;

said male and female components including male connector portions and female connector portions;

each of said male connector portions including a base with extending side walls, abutment flanges on the side walls, converging slant walls, wall sections with a plurality of outward protrusions and an end wall;

each of said female connector portions being slidably engaged within adjacent male connector portions, and comprising an inside end wall, substantially parallel side walls, outer end walls, substantially parallel inward walls, slant walls, wall sections with a plurality of depressed sections thereon, and a terminal wall;

the outward protrusions of the male connectors fitting within the depressed sections of the female connectors to interlock the connectors to one another;

a series of beams to interconnect adjacent series of floor panels;

inclined male supports extending along each of the longitudinal sides of the assembled floor system;

side walls systems secured to the floor systems at the inclined male supports thereof, the said wall systems including substantially rectangular side panels in vertical pairs, and angled beams intersecting adjacent sets of the panels;

each panel system of a side wall comprising interengaged panel members;

an end panel system for each end of the structure;

a series of corner beams interconnecting the side walls and end panels; and a main ridge pole interengaging the side panels extending from opposite longitudinal sides of said floor.

8. A building construction as defined in claim 7, wherein:

the main ridge pole is sectional and the sections are joined by lock means.

9. The invention of claim 7, wherein:

the ridge pole is provided with a seal and an end cap.

10. The invention of claim 9, wherein the seal is engaged with the ridge pole by slidable engagement of a T bar and T slot.

11. The invention of claim 7, and:

an end seal on the floor panels slidably engaged thereon.

* * * * *